United States Patent [19]

Vick et al.

[11] 4,062,291

[45] Dec. 13, 1977

[54] BALLAST TAMPING TOOL

[76] Inventors: Edward L. Vick, 4861 Seven Hills Road, Castro Valley, Calif. 94546; Arlie E. Smith, 3791 Mosswood Drive, Lafayette, Calif. 94549

[21] Appl. No.: 654,395

[22] Filed: Feb. 2, 1976

Related U.S. Application Data

[63] Continuation-in-part of Ser. No. 553,315, Feb. 24, 1975, abandoned.

[51] Int. Cl.[2] ..... E01B 27/00

[52] U.S. Cl. ..... 104/10; 104/12

[58] Field of Search ..... 104/1 R, 10, 12, 13, 104/14; 151/26; 294/54, 56; 37/142 R

[56] References Cited

U.S. PATENT DOCUMENTS

| | | | |
|---|---|---|---|
| 511,270 | 12/1893 | Horner | 151/26 |
| 1,813,295 | 7/1931 | Jackson | 104/12 |
| 2,463,124 | 3/1949 | Sims | 37/142 R |
| 2,893,298 | 7/1959 | Averette | 37/142 R |
| 2,921,391 | 1/1960 | Opsahl | 37/142 R |
| 3,581,664 | 6/1971 | Kruse | 104/10 |

*Primary Examiner*—Robert J. Spar
*Assistant Examiner*—Randolph A. Reese
*Attorney, Agent, or Firm*—Warren, Chickering & Grunewald

[57] ABSTRACT

The tool comprises an elongated bar adapted for mounting at its normally upper end in a ballast tamping machine of conventional construction, and a tamper foot demountably secured to the opposite, normally lower end of the bar, the particular improvement consisting of a demountable, locked, pressure-fitted, dovetail connection between the foot and bar.

3 Claims, 7 Drawing Figures

BALLAST TAMPING TOOL

This application is a continuation-in-part of application Ser. No. 553,315, filed Feb. 24, 1975 for Ballast Tamping Tool, now abandoned.

BACKGROUND OF THE INVENTION

1. Field of Invention

The invention relates to ballast tamping machines such as used on railway tracks for supporting, adjusting and leveling the railway ties, and more particularly, to the tamping tools which are mounted for vertical reciprocation in such machines.

2. Description of Prior Art

In tamping machines in common use, a plurality of tamper bars are mounted for vertical reciprocation in a power-driven tamper bar support structure of the tamping machine so that the lower ends of the bars are driven downwardly into impact with the ballast mounted under and between the railway ties. In this action, the bars are also vibrated about their axes so as to impart a relatively high speed oscillatory action to the tamping tools for aiding their entry into and impacting of the ballast. Commonly, after the tools have entered a prescribed distance into the ballast, they are drawn towards each other on opposite sides of a tie, causing the ballast to move in under and to elevate the tie to a desired level of the track. The present tamper bar is designed for use with tamping machines manufactured by Tamper, West Columbia, S.C. and Plasser American Corp. of Chesapeake, Va.

As will be understood, the principal wear and deterioration of the tamping foot will occur at its lower end, where it impacts and works against the ballast. It has been heretofore proposed, see U.S. Pat. No. 3,581,664, to fit the bottom of the tamping bar with a replaceable tamper foot. During the foregoing described action, however, heavy lateral and vertical stresses are placed on the foot and its connection to the tamper bar, causing bolts to loosen with resultant premature failure of the tamper foot and bolts themselves. The use of a dovetail connection between the tamper bar and foot aids in the securing of the foot and partially relieves the stress on fastening bolts and the like. However, the driving action of the tamper feet through the ballast forces sand at high pressure between the engaged surfaces of the bar and foot, which in turn throws the load onto the fastening bolts, causing their premature fracture. Moreover, exposure of bolt heads, nuts and other fastening parts to the driving, abrasive action of the ballast quickly abrades and causes early failure of the exposed fastener parts.

Where demountable tamper feet have been secured to the lower ends of the tamping bars, it has been found necessary to weld or epoxy the bolts, against loosening and premature failure. To change the tamper foot, therefore, it has been necessary to remove the bar and foot as an entirety from the tamping machine and transport the integral bar and worn foot to a repair shop where, with the use of appropriate grinding and/or cutting machinery, the worn foot may be removed and a new foot secured in place and rewelded and shipped back to the job site. All of these operations entail a significant loss of time, since the tamping machine may be working on tracks far removed from the closest repair shop. As will also be understood, transportation from such remote track areas to repair shops is difficult, since it requires the most uneconomical stopping of a passing train or the running of a special motorized car between the job site and repair shop.

No structure has been heretofore proposed which will permit the satisfactory renewal in the field of demountable tamper feet on the tamper bars, and particularly without the removal of the tamper bars from the tamping machine.

SUMMARY OF INVENTION

The structure of the present invention provides a combination of a demountable dovetail attachment between the tamper bar and foot, fastening means for placing the dovetail connection into positive compressive engagement to thus effectively prevent the hydraulic pumping of sand under high pressure into the joint surfaces of the foot and bar, and manually releasable means for positively locking the parts in their compressive engagement throughout the useful life of the foot.

Another feature and object of the present invention is to provide a ballast tamping tool of the character described in which the separate foot may be conveniently and expeditiously removed and replaced in the field and without requiring the removal of the tamper bar from the tamper machine.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
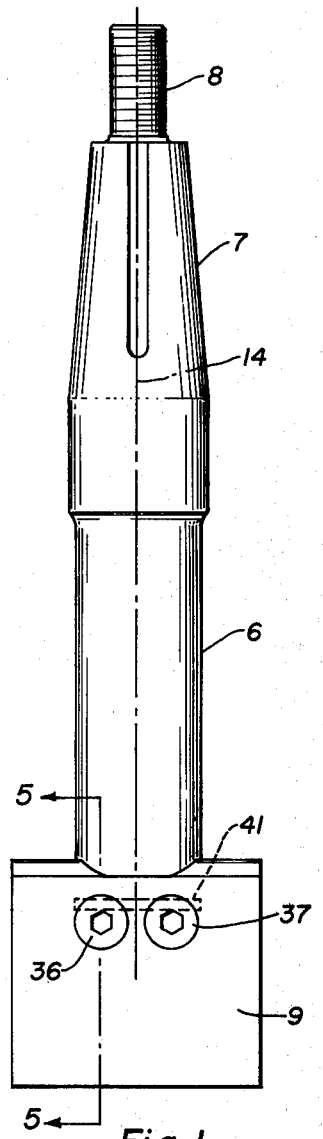
FIG. 1 is a front elevation of a ballast tamping tool constructed in accordance with the present invention.

The ballast tamping tool of the present invention is adapted for use with conventional railway ballast tamping machines which are mounted for travel along the rails for tamping the ballast lying under and between the railway ties. Accordingly, the tool of the present invention comprises an elongated bar 6, which is formed with a keyed and tapered upper shank section 7 having a threaded end stud 8 formed for mounting in and fastening to the standard tapered chuck of the tamping machine. As will be understood, a plurality of tools of the type here illustrated is usually carried by and simulataneously driven by the machine with the tools arrayed in opposed pairs spaced for straddling a tie for simultaneous impacting and movement of the ballast on opposite sides of the tie. At the lower end of each bar 6 and demountably secured thereto is a plate-like tamper foot 9.

The improvement of the present invention comprises, briefly, the attaching structure for the demountable foot in which the foot is positively and securely held in proper position for tamping throughout its effective life and yet may be conveniently and readily removed in the field when periodic renewal of the foot is required. Three structural elements cofunction to attain this objective. First, a dovetail connection is provided between the bar and foot for withstanding and transmitting the very high impact forces to which the parts are subjected. Secondly, demountable fastening means such as bolts 11 and 12 are used for holding the parts in assembled position with the dovetail connection relieving the strain which would otherwise be imposed on the bolts. As a very important feature of the present invention, the fastening means applies a positive relative longitudinal displacing force on the bar and foot for placing the dovetail connection into compressive engagement. Thus, the interfitting dovetail connections are tightly compressed together and prevent the hydraulic pumping of sand into the joint for separating the parts, transferring the load to the bolts, and resulting in premature failure. Thirdly, means is provided for positively locking the bolts in their tightened, foot-clamping, dovetail-compression position.

Figure 2:
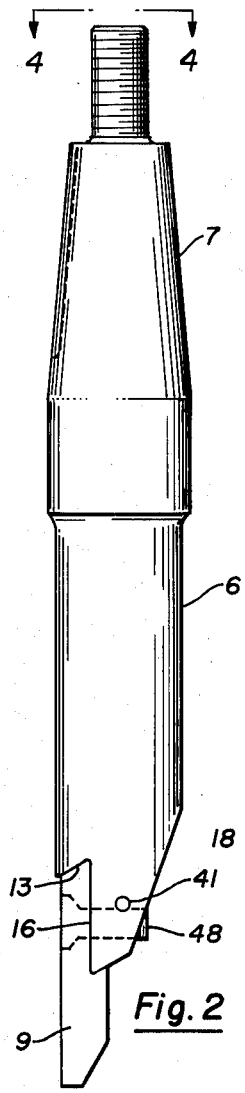
FIG. 2 is a side elevation of the tool.
Figure 4:
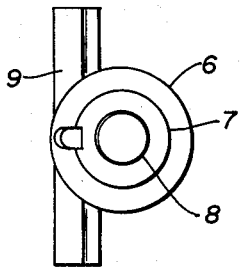
FIG. 4 is a plan view of the tool.
Figure 5:
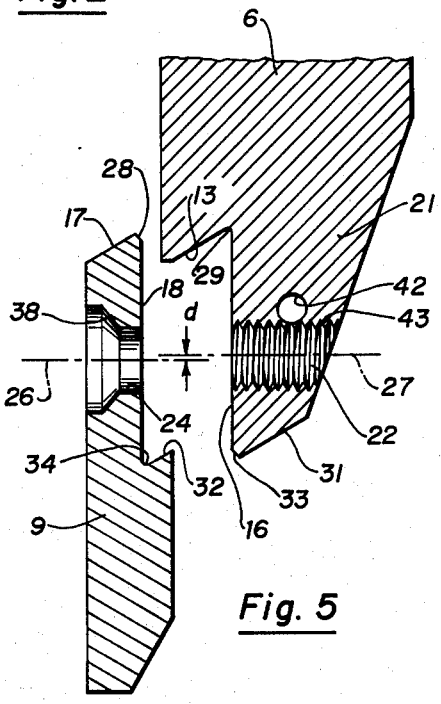
FIG. 5 is a cross-sectional view on a somewhat enlarged scale of a portion of the bar and the demountable foot shown in detached position, the view being taken on the plane of line 5—5 of FIG. 1.
Figure 6:
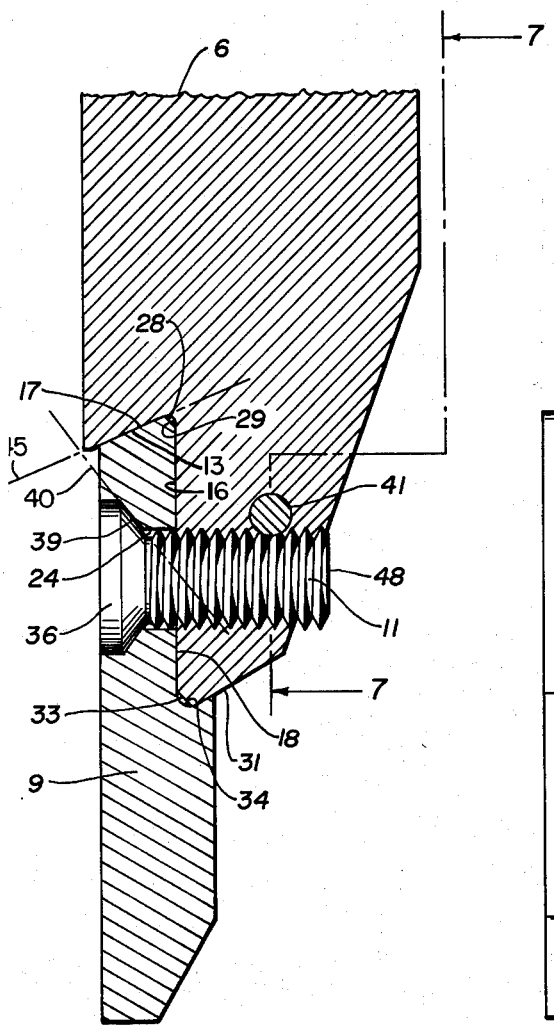
FIG. 6 is a cross-sectional view on a somewhat further enlarged scale of the parts shown in FIG. 5 in attached position.

With reference to FIGS. 2, 5 and 6, bar 6 is formed with a laterally offset surface 13 sloping upwardly and inwardly with respect to the longitudinal axis 14 of the bar, and a longitudinally extending surface 16 extending from the inner end of surface 13; and foot 9 is formed with an upper end surface 17 sloping inwardly and upwardly with respect to axis 14 and a longitudinally extending surface 18 contiguous with the inner end of surface 17, surfaces 17 and 18 being dimensioned to mate with surfaces 13 and 17 forming a mortise and surfaces 16 and 17 forming a tenon in a fitted mortise and tenon joint forming one-half of the aforementioned dovetail connection.

The structure for attaining the aforementioned relative longitudinal displacing force on the foot and bar for placing the mortise and tenon joint into compressive engagement is best illustrated in FIG. 5 of the drawings. The lower end 21 of bar 6 is formed with a pair of threaded bolt-receiving openings 22 and 23 extending substantially perpendicular to surface 16, and foot 9 is formed with a pair of bolt-receiving openings 24 extending substantially perpendicular to surface 18 and spaced transversely for registering with openings 22 and 23. However, the axes 26 and 27 of openings 24 and of openings 22 and 23 are longitudinally offset by dimension *d*, as seen in FIG. 5, which offset cooperates with similar bar and foot dimensions to provide positive compressive engagement of mortise and tenon joint provided by surfaces 13, 16, 17 and 18. In order to insure the compressive fit of the surfaces 13, 16, 17 and 18, the following dimensional tolerances are suggested:

1. surfaces 13 and 17 are machined to smooth finish with the dimension tolerance between surface 13 and axis 27 held to between $-0.002$ and 0, and the dimension tolerance between surface 17 and axis 26 held to between $+0.002$ and 0; and 2. the longitudinal offset of axes 26 and 27 is set at approximately $0.010 \pm 0.002$ inch (the above permitted tolerances).

Additionally, in order to insure a tight, compressive fit of the mortise and tenon surfaces, the upper inner edge 28 of the foot is foreshortened and the adjacent upper corner 29 of the bar is rounded in a radius, as illustrated, to insure full entry of the foot into the receiving recess and, at the same time, remove a critical stress point at the inside corner of the structure. Finally, the bolts are tightened in place with a torque, preferably in excess of 150 foot pounds for drawing the interfitted surfaces into tightly compressed engagement.

Preferably, a second, cooperating, lower, mortise and tenon joint is provided for the bar and foot. With reference to FIGS. 2, 5 and 6, it will be noted that bar 6 is formed at its lower end 31 with a laterally offset surface contiguous to and sloping upwardly from surface 16; and foot 9 is formed with a lower laterally offset surface 32 contiguous to surface 18 and sloping upwardly therefrom. Surfaces 18 and 32 are structured to mate with surfaces 16 and 31 to form a second mortise and tenon joint. Preferably, the dimensions of the parts are maintained so as to close this lower joint without impairing or interfering with the all important compressive closure of the upper mortise and tenon joint, as above explained.

Figure 3:
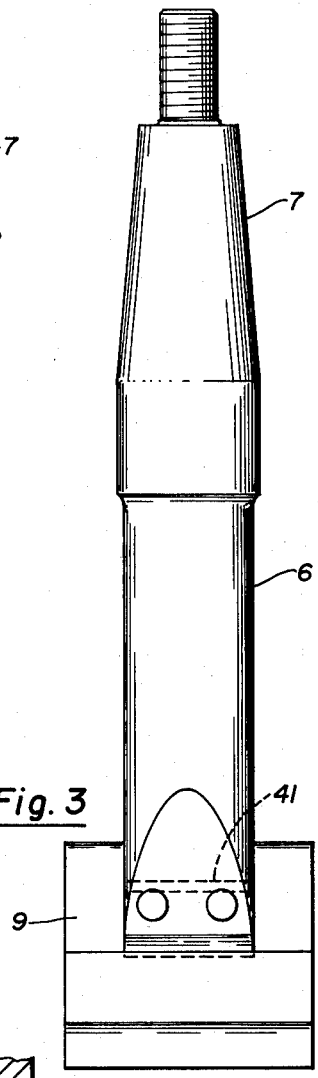
FIG. 3 is a rear elevation of the tool.
Figure 7:
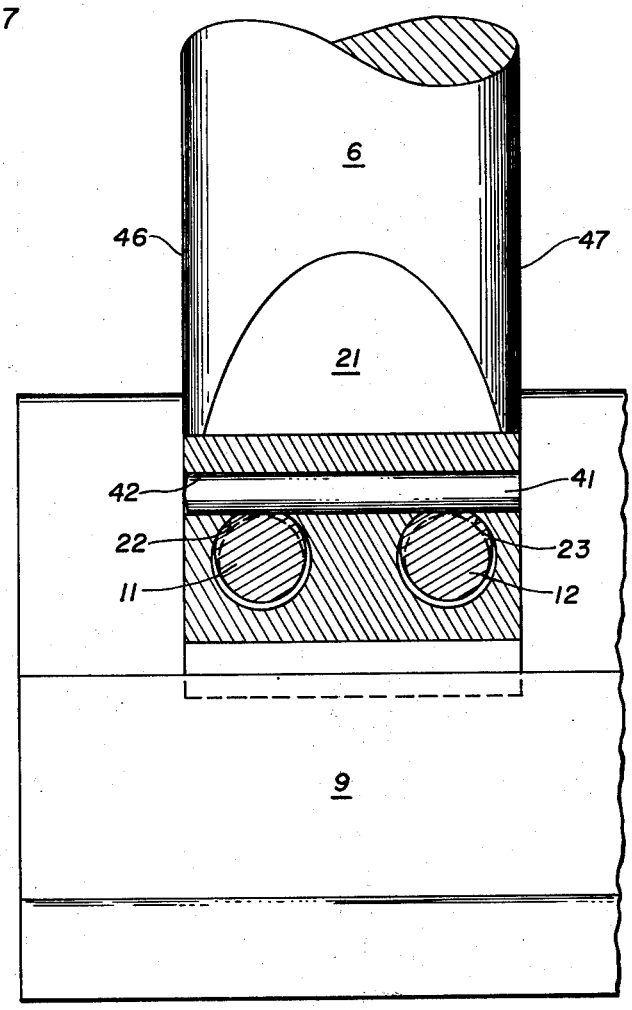
FIG. 7 is a fragmentary cross-sectional view of the tool taken substantially on the plane of line 7—7 of FIG. 6.

As another and important feature of the present construction, bolts 11 and 12 are formed with frusto-conical heads 36 and 37 and the foot openings 24 are formed with frusto-conical sockets 38 dimensioned for receiving and mating with bolt heads 36 and 37. In such a structure, and as will be noted in FIG. 6, the bolt heads will bear on the normally upper side 39 of the sockets with a wedging action, urging the aforementioned relative longitudinal displacement of foot 9 with respect to bar 6 and cooperating in the accomplishing of the critical compressive engagement of the upper mortise and tenon joint. As will be observed from FIG. 6, the slope of surface 39 as represented by axis line 40, flares with respect to the slope of surfaces 13 and 17, as represented by axis line 45 so as to define the other half of the important dovetail connection. Preferably, and as here shown, the bolt-securing means is arranged in a pair of bolt openings, sockets and bolts disposed in transversely spaced relation on opposite sides of the longitudinal axis 14, as seen in FIGS. 1, 3 and 7.

As hereinabove noted, the usage to which the present ballast tamping tool is subjected makes it mandatory that the parts be securely locked in finally assembled form against the very high stresses and vibratory action which characterize the operation of the tool. One possibility is to weld the bolts in their tightened position. However, such a structure requires the transporting of a worn tool to a reasonably well equipped repair shop in order to effect a replacement of the foot. As hereinabove noted, one of the principal features of the present invention is to permit for the first time a convenient and expedient replacement of a tamper foot in the field, and to do so without requiring the removal of the tamper bar from the tamping machine. This unique structure here includes a pin 41 carried by bar end 21 and which is driven through at least one of the bolt threads for keying bolt in its tightened position against rotation. Preferably, bar end 21 is formed with a through bore 42 which extends transversely to bolt opening 22 and in intersecting relation to its threaded periphery 43; and pin 41 is dimensioned for driving through bore 42 and thus engaging and shearing off at least one of the threads of the bolt in opening 22, thus forming a "flat" on the bolt periphery and a keying of the bolt against rotation. Where a pair of bolts 11 and 12 is used, as in the present embodiment, bore 42 is formed to extend transversely across the lower end of the bar, that is, between sides 46 and 47 thereof, see FIG. 7, so as to intersect the threaded periphery of both of the bolt openings 22 and 23. Pin 41 may be driven into bore 42 from either side thereof with the leading end of the pin squared off or sharpened or otherwise formed to cut or break through the threaded peripheries of bolts 11 and 12. The form of the leading edge of the bolt is not critical, since only a small peripheral thread on each bold need be cut through.

To replace a worn foot in the field, a conventional drive pin may be used to dislodge and remove shear pin 41, following which bolts 11 and 12 may be backed out to remove the worn foot. The bolt heads 36 and 37 may be formed with polygonal sockets, as illustrated, for receiving an Allen wrench. Due to the high stressing of the parts in assembled position, as above explained, heating of the bolts, as with a torch, will facilitate their removal. After removal of the bolts and worn foot, a new foot can be immediately mounted on the bar, using new bolts and a new shear pin and following the assembly instructions, as above explained.

As will be noted also from the drawings, the bolt heads fit within the receiving sockets to provide a flush outer surface, thus protecting the bolt heads against abrasion in the use of the tool. Any portion of the bolts projecting from the working surfaces of the tool will be rapidly abraded away. Thus any projection of the free end 48 of the bolts from the lower end of the bar will be rapidly worn back to the bar suface. However, at bolt ends 48 such abrasion is harmless.

What is claimed is:

1. An elongated bar and a separate tamper foot and demountable attaching structure for said bar and foot adapted for driving with said foot into and through ballast to be tamped, the improvement comprising:

said bar having a laterally offset surface and an adjacent longitudinally extending surface and said foot having an upper end and an adjacent longitudinally extending surface forming mating mortise and tenon and interfitting in a mortise and tenon joint;

said bar having a threaded opening at and extending substantially perpendicular to its said longitudinal surface, and said foot being formed with a bolt-receiving opening at and extending substantially perpendicular to its longitudinally extending surface;

the spacing between the axis of said bar opening and said joint being less than the spacing between the axis of said foot opening and said joint;

a bolt mounted in said foot opening and threadably engaged in said bar opening and effecting relative displacement of said tenon into said mortise;

said foot opening being formed with an enlarged frusto-conical bolt-receiving socket, and said bolt having a head of mating frusto-conical form, said bolt head bearing on the normally upper side of said socket and wedge-driving said mortise and tenon joint into compressive engagement;

said bar having a bore opening to a side thereof and extending transversely to and intersecting the periphery of said threaded opening; and a pin mounted in said bore and driven through at least one of the threads of said bolt to key said bolt against rotation.

2. Apparatus as defined in claim 1, said bar offset surface and said foot upper end being in face-to-face contact on a plane sloping outwardly and downwardly with respect to the longitudinal axis of said bar, and said bolt head and socket being engaged on a line sloping outwardly and upwardly with respect to said axis to define a dovetail connection.

3. Apparatus as defined in claim 1, having a pair of said bar and foot openings and a pair of said bolts disposed in transversely spaced relation between opposite sides of said bar and on opposite sides of the longitudinal center line of said bar;

said bore extending through said bar between said opposite sides and intersecting the periphery of each of said bar openings; and said pin being driven through at least one thread on each of said bolts to simultaneously key said bolts against rotation.

* * * * *

UNITED STATES PATENT AND TRADEMARK OFFICE

CERTIFICATE OF CORRECTION

PATENT NO. : 4,062,291

DATED : December 13, 1977

INVENTOR(S) : Edward L. Vick and Arlie E. Smith

It is certified that error appears in the above-identified patent and that said Letters Patent are hereby corrected as shown below:

In FIGURE 6, pertaining to the dashed slope line of shoulder 13:

delete "15" and insert ---45---.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*